US007475736B2

(12) United States Patent
Lehr et al.

(10) Patent No.: US 7,475,736 B2
(45) Date of Patent: Jan. 13, 2009

(54) SELF CENTRALIZING NON-ROTATIONAL SLIP AND CONE SYSTEM FOR DOWNHOLE TOOLS

(75) Inventors: Douglas J. Lehr, The Woodlands, TX (US); Gabriel A. Slup, Spring, TX (US)

(73) Assignee: BJ Services Company, Houston, TX (US)

( * ) Notice: Subject to any disclaimer, the term of this patent is extended or adjusted under 35 U.S.C. 154(b) by 82 days.

(21) Appl. No.: 11/595,792

(22) Filed: Nov. 9, 2006

(65) Prior Publication Data

US 2007/0102165 A1 May 10, 2007

Related U.S. Application Data

(60) Provisional application No. 60/736,096, filed on Nov. 10, 2005.

(51) Int. Cl.
*E21B 33/129* (2006.01)

(52) U.S. Cl. ..... 166/386; 166/120; 166/134

(58) Field of Classification Search ..... 166/120, 166/134, 206, 386
See application file for complete search history.

(56) References Cited

U.S. PATENT DOCUMENTS

| | | | | |
|---|---|---|---|---|
| 1,684,266 A | | 9/1928 | Fisher et al. | |
| 2,204,659 A | * | 6/1940 | Burt | 166/217 |
| RE21,677 E | | 12/1940 | Tremolada | 255/19 |
| 2,331,532 A | | 10/1943 | Bassinger | 166/12 |

(Continued)

FOREIGN PATENT DOCUMENTS

CN 2690585 Y 4/2005

(Continued)

OTHER PUBLICATIONS

PCT International Search Report and Written Opinion mailed Jan. 23, 2008, corresponding to PCT/US2007/019793, filed Sep. 12, 2007, which is the PCT application based on U.S. Appl. No. 11/520,100 (commonly owned by Assignee, with the present application).

(Continued)

*Primary Examiner*—William P Neuder
(74) *Attorney, Agent, or Firm*—Howrey LLP

(57) ABSTRACT

An improved cone and integral slip assembly is described for use in the anchoring assembly of a downhole tool, such as a bridge plug, frac plug, or cement retainer. The cone may include external fins that are integral to and run axially along the cone. The integral slip assembly includes at least one axial slot, which facilitates subsequent breaking up of the integral slip assembly into individual slip segments. Each slip segment may include a channel that is adapted to mate with an external fin of the cone. As the integral slip assembly traverses the cone, the channels of the slip segments ride on the fins encouraging the integral slip assembly to break apart along the slots into the slip segments. The spacing of the fins and corresponding channels in the slip segments are positioned such to ensure that the slip segments are advantageously positioned around the cone thus, locating the packing element of the plug in the center of the wellbore. The channels in the slip segments mating with the fins also provide an anti-rotation mechanism to facilitate removal of the tool.

30 Claims, 7 Drawing Sheets

U.S. PATENT DOCUMENTS

| | | | | | |
|---|---|---|---|---|---|
| 3,076,509 | A | | 2/1963 | Burns et al. | 166/70 |
| 3,094,170 | A | | 6/1963 | Bourne, Jr. | 166/224 |
| 3,189,316 | A | | 6/1965 | Preston, Jr. | 251/74 |
| 3,298,385 | A | | 1/1967 | Jackson et al. | 137/112 |
| 3,299,955 | A | | 1/1967 | Page, Jr. | 166/48 |
| 3,375,874 | A | | 4/1968 | Cherry et al. | 166/114 |
| 3,479,829 | A | | 11/1969 | Goodman | 61/53.6 |
| 3,481,397 | A | | 12/1969 | Baker | 166/225 |
| 3,497,002 | A | * | 2/1970 | Berryman | 166/123 |
| 3,497,003 | A | * | 2/1970 | Kisling et al. | 166/134 |
| 3,506,067 | A | * | 4/1970 | Lebourg | 166/134 |
| 3,530,934 | A | * | 9/1970 | Kisling | 166/134 |
| 3,550,683 | A | | 12/1970 | Comeaux | 166/156 |
| 3,687,196 | A | | 8/1972 | Mullins | 166/217 |
| 3,720,264 | A | | 3/1973 | Hutchison | 166/311 |
| 3,727,691 | A | | 4/1973 | Muecke et al. | 166/295 |
| 3,750,749 | A | | 8/1973 | Giroux | 166/95 |
| 3,828,852 | A | | 8/1974 | Delano | 166/78 |
| 3,867,984 | A | | 2/1975 | Dufrene | 166/188 |
| 3,971,436 | A | | 7/1976 | Lee | 166/70 |
| 4,151,875 | A | | 5/1979 | Sullaway | 166/126 |
| 4,162,619 | A | | 7/1979 | Nixon, Jr. | 464/20 |
| 4,185,690 | A | | 1/1980 | Kinney | 166/183 |
| 4,188,999 | A | | 2/1980 | Amancharla | 166/133 |
| 4,190,111 | A | | 2/1980 | Davis | 166/291 |
| 4,258,788 | A | | 3/1981 | Patton et al. | 166/185 |
| 4,266,620 | A | | 5/1981 | Wolgamott et al. | 175/215 |
| 4,313,497 | A | | 2/1982 | Graham | 166/124 |
| 4,349,071 | A | | 9/1982 | Fish | 166/124 |
| 4,393,930 | A | | 7/1983 | Ross et al. | 166/188 |
| 4,401,161 | A | | 8/1983 | Warren | 166/178 |
| 4,427,065 | A | | 1/1984 | Watson | 166/250 |
| 4,436,150 | A | | 3/1984 | Barker | 166/131 |
| 4,467,867 | A | | 8/1984 | Baker | 166/188 |
| 4,478,286 | A | | 10/1984 | Fineberg | 166/324 |
| 4,479,548 | A | | 10/1984 | Gilbert | 166/387 |
| 4,520,879 | A | | 6/1985 | MacElvain | 173/57 |
| 4,589,495 | A | | 5/1986 | Langer et al. | 166/383 |
| 4,597,449 | A | | 7/1986 | Keeney | 166/373 |
| 4,646,829 | A | | 3/1987 | Barrington et al. | 166/125 |
| 4,708,202 | A | | 11/1987 | Sukup et al. | 166/123 |
| 4,722,389 | A | | 2/1988 | Arnold | 166/70 |
| 4,796,707 | A | | 1/1989 | Halbardier | 166/387 |
| 4,834,184 | A | | 5/1989 | Streich et al. | 166/376 |
| 4,836,279 | A | | 6/1989 | Freeman | 166/153 |
| 4,972,908 | A | | 11/1990 | Braddick | 166/387 |
| 4,986,361 | A | | 1/1991 | Mueller et al. | 166/381 |
| 5,020,597 | A | | 6/1991 | Braddick et al. | 166/291 |
| 5,048,612 | A | | 9/1991 | Cochran | 166/382 |
| 5,117,915 | A | | 6/1992 | Mueller et al. | 166/381 |
| 5,137,090 | A | | 8/1992 | Hare et al. | 166/325 |
| 5,181,571 | A | | 1/1993 | Mueller et al. | 166/381 |
| 5,211,224 | A | | 5/1993 | Bouldin | 166/63 |
| 5,224,540 | A | | 7/1993 | Streich et al. | 166/118 |
| 5,271,468 | A | | 12/1993 | Streich et al. | 166/387 |
| 5,318,131 | A | | 6/1994 | Baker | 166/382 |
| 5,332,038 | A | | 7/1994 | Tapp et al. | 166/278 |
| 5,390,737 | A | | 2/1995 | Jacobi et al. | 166/184 |
| 5,413,172 | A | | 5/1995 | Laurel | 166/153 |
| 5,449,040 | A | | 9/1995 | Milner et al. | 166/382 |
| 5,451,084 | A | | 9/1995 | Jansch | 294/1.1 |
| 5,540,279 | A | | 7/1996 | Branch et al. | 166/118 |
| 5,669,448 | A | | 9/1997 | Minthorn et al. | 166/308 |
| 5,701,959 | A | | 12/1997 | Hushbeck et al. | 166/387 |
| 5,829,531 | A | | 11/1998 | Hebert et al. | 166/382 |
| 5,839,515 | A | | 11/1998 | Yuan et al. | 166/387 |
| 5,865,251 | A | | 2/1999 | Rebardi et al. | 166/278 |
| 5,984,007 | A | | 11/1999 | Yuan et al. | 166/134 |
| 6,167,963 | B1 | | 1/2001 | McMahan et al. | 166/179 |
| 6,220,348 | B1 | | 4/2001 | Serafin et al. | 166/133 |
| 6,220,349 | B1 | | 4/2001 | Vargus et al. | 166/138 |
| 6,244,642 | B1 | | 6/2001 | Serafin et al. | 294/86.17 |
| 6,311,778 | B1 | | 11/2001 | Carisella et al. | 166/382 |
| 6,328,109 | B1 | | 12/2001 | Pringle et al. | 166/373 |
| 6,354,372 | B1 | | 3/2002 | Carisella et al. | 166/118 |
| 6,390,190 | B2 | | 5/2002 | Mullins | 166/90.1 |
| 6,394,180 | B1 | | 5/2002 | Berscheidt et al. | 166/193 |
| 6,491,108 | B1 | | 12/2002 | Slup et al. | 166/387 |
| 6,491,116 | B2 | | 12/2002 | Berscheidt et al. | 175/57 |
| 6,578,633 | B2 | | 6/2003 | Slup et al. | 166/118 |
| 6,581,681 | B1 | | 6/2003 | Zimmerman et al. | 166/135 |
| 6,708,770 | B2 | | 3/2004 | Slup et al. | 166/387 |
| 6,772,842 | B2 | | 8/2004 | Read et al. | 166/332.8 |
| 2002/0066577 | A1 | | 6/2002 | Dewey et al. | 166/382 |
| 2002/0096365 | A1 | | 7/2002 | Berscheidt et al. | 175/57 |
| 2002/0148615 | A1 | | 10/2002 | Szarka et al. | 166/332.4 |
| 2004/0003928 | A1 | | 1/2004 | Frazier | 166/387 |
| 2004/0045723 | A1 | | 3/2004 | Slup et al. | 166/386 |
| 2005/0257936 | A1 | | 11/2005 | Lehr | 166/386 |
| 2007/0119600 | A1 | | 5/2007 | Slup et al. | 166/387 |

FOREIGN PATENT DOCUMENTS

| | | | | |
|---|---|---|---|---|
| EP | 0498990 | A1 | 8/1992 | |
| EP | 1116860 | A | 7/2001 | 33/129 |
| GB | 2337064 | A | 11/1999 | 33/129 |
| WO | WO 01/09480 | | 2/2001 | |
| WO | WO 02/02906 | A | 1/2002 | 33/129 |

OTHER PUBLICATIONS

PCT International Search Report and Written Opinion corresponding to PCT/US2006/043540, dated Apr. 12, 2007.
Notice of Allowability, U.S. Appl. No. 10/658,979, Mail Date May 23, 2007 (4 pgs.).
Website printout "ServaMAP Frac Plug Model FPE" www.mapoiltools.com printed Nov. 22, 2002.
Website printout "Mod A Ball Check Cement Retainer" www.alphatx.com printed Nov. 22, 2002.
"Big Bore Frac Plug" Alpha Oil Tools, 1996, 1997.
"Quik Drill Composite Frac Plug" Baker Oil Tools, Copyright 2003.
Halliburton's "FAS Drill" product sheets (FAS Drill® Frac Plug, © 1999 Halliburton Energy Services, Inc.; FAS Drill® Squeeze Packers and Sliding-Valve Packers, © 1997 Halliburton Energy Services, Inc.; FAS Drill® Bridge Plugs, © 1997 Halliburton Energy Services, Inc.).
Baker, "A Primer of Oilwell Drilling", Sixth Edition, published by Petroleum Extension Service in cooperation with International Association of Drilling Contractors, 2001; first published 1951.
Long, Improved Completion Method for Mesaverde-Meeteetse Wells in the Wind River Basin, SPE 60312, Copyright 1999.
Savage, "Taking New Materials Downhole—The Composite Bridge Plug", PNEC 662,935 (1994).
Guoynes, "New Composite Fracturing Plug Improves Efficiency in Coalbed Methane Completions" SPE 40052, Copyright 1998.
Baker Hughes' web page for "Quik Drill™ Composite Bridge Plug" (Jul. 16, 2002).
Baker Service Tools Catalog, p. 26, [date unknown] "Compact Bridge Plug Model P-1."
Baker Service Tools Catalog, p. 6, Unit No. 4180, Apr. 26, 1985, "E-4 Wireline Pressure Setting Assembly."
Baker Oil Tools Catalog, 1998, "Quik Drill Composite Bridge Plug."
Baker Service Tools Catalog, p. 26, [date unknown] "Model T Compact Wireline Bridge Plug."
Baker Service Tools Catalog, p. 24 [date unknown] "Model S, N-1, and NC-1 Wireline Bridge Plugs."
Society of Petroleum Engineers Article SPE 23741; © 1992.
Baker Sand Control Catalog for Gravel Pack Systems; © 1988.
Offshore Technology Conference papers OTC 7022, "Horizontal Well Completing, Oseberg Gamma North," Bjorkeset et al.; © 1992.
"Water-packing Techniques Successful in Gravel Packing High-Angle Wells," Douglas J. Wilson and Mark F. Barrilleaux, Oil and Gas Journal © 1991.
"Tape-laying precision industrial shafts", by Debbie Stover, Senior Editor; High-Performance Composites Jul./Aug. 1994.
UK Patent Office's Combined Search and Examination Report dated Jun. 29, 2004.

* cited by examiner

SELF CENTRALIZING NON-ROTATIONAL SLIP AND CONE SYSTEM FOR DOWNHOLE TOOLS

CROSS REFERENCE TO RELATED APPLICATION

This application is a Non-provisional application claiming priority to U.S. Provisional Application Ser. No. 60/736,096, entitled, "Self Centralizing Non-Rotational Slip and Cone System for Downhole Tools," by Gabriel A. Slup and Douglas J. Lehr, filed Nov. 10, 2005, hereby incorporated by reference in its entirety herein.

BACKGROUND OF THE INVENTION

1. Field of the Invention

The present invention relates generally to an anchoring assembly for a downhole tool. The anchoring assembly includes an improved cone and slip assembly system to set a downhole tool in a wellbore. The improved cone and integral slip assembly are adapted to interact break the slip assembly into slip segments at predetermined locations as the integral slip assembly traverses the cone. The improved cone and integral slip assembly are adapted to facilitate the centering of a packing element when setting the downhole tool in the wellbore.

2. Description of the Related Art

The drilling and servicing of gas and oil wells often requires the isolation of certain zones within the well. Typically, the isolation of a zone is accomplished by the insertion of a downhole tool, such as a bridge plug, fracturing plug, or cement retainer, into the wellbore. The purpose of the tool is simply to isolate a portion of the well from another portion or the rest of the well. For instance, perforations in the well in one portion may need to be isolated from perforations in another portion of the well, or there may be a need to isolate the bottom of the well from the wellhead. Further, a permanent plug may be used to permanently close off and abandon the well.

A downhole tool, such as typical wellbore plug, generally is comprised of an anchoring assembly arranged about a mandrel that is run into the wellbore. The anchoring assembly typically includes a plurality of slips and a cone, as well as an elastomeric packing element. The slips may be arranged in a slip ring, or the slips may be initially formed in a ring, the slips being designed to break apart upon the application of an axial load. Regardless, the slips include a tapered surface that is adapted to mate with a tapered surface of the cone. As an axial force is applied to the downhole tool, the slips ride up on the tapered surface of the cone, and are thus driven outwardly, away from the mandrel, and into the wellbore to set the tool.

Specifically, the downward force applied to the anchoring assembly causes the upper slips to move up the upper cone. As the upper slip traverses the upper cone, the tapered shape of the upper cone moves the upper slip outward and the upper slip engages the casing wall, thus locking the anchoring assembly in place within the well. Once the anchoring assembly is locked within the well, the upward force moves the lower portion of the assembly (i.e., lower cap, lower cone, and lower slip) upward toward the upper portion of the assembly. Because the upper portion is anchored against the wall, the movement of the lower portion axially compresses the packing element.

Further application of axial force compresses the elastomeric packing element, driving the packing element outwardly to contact and seal against the wellbore. The axial compression of the packing element causes the packing element to expand radially against the well casing creating a sealing barrier that isolates a portion of the well. Once the packing element has been compressed and radially expanded, the upward force causes the lower slip to traverse the lower cone.

The tapered shape of the lower cone moves the lower slip outward until it engages the well casing, thus locking the lower portion of the anchoring assembly in place within the well. The locking of the lower portion of the anchoring assembly ensures that the packing element remains radially expanded against the well casing while the downhole tool is set.

When setting the packing element, it is important that the packing element be centered within the wellbore so that a uniform, circular extrusion gap exists around the packing element. Packing elements are design to expand evenly against the well casing. If not centered within the well, it will be more difficult for the packing element to completely bridge the gap to create a seal and isolate a portion of the well. In order to bridge an uneven gap, an excessive downward force may be needed to set the packer. This increased force as well as the uneven expansion of the packing element against the wellbore may cause the premature failure of the packing element.

As described above, present anchoring assemblies may include a solid slip ring, placed about the mandrel. Alternatively, solid slip rings are known which are adapted to break into individual slips during the setting operation. Each of these slip ring helps to ensure the central alignment of the assembly and the packing element within the well.

However, it is not uncommon for these prior art slip rings to break in the single weakest spot along the ring. This spot may be the weakest due to a variance in material thickness or a pre-existing defect.

A solid slip ring having a single axial break is herein after referred to as a "c-ring." While the c-ring may still properly anchor the assembly after traversing the cone, the anchoring assembly may shift on the mandrel to the same orientation as the break of the c-ring. Thus, the c-ring does not properly center the packing element within the well leading to the possibility that the packing element will prematurely fail, as described above.

In light of the foregoing, it would be desirable to provide a slip assembly that does not break at an area of weakness into a c-ring, but rather accurately breaks into a plurality of designated slip segments. Further, it would be desirable to provide a solid slip ring that as it traverses the cone breaks into designated segments that ensure that the packing element is centered within the wellbore.

Further, removal of the components of downhole tools can be problematic. For example, once the plug described above has performed its function and it is desired to remove the plug, a drill or mill is run downhole to remove the plug. In some instances, components of the downhole tool, which contact the drill or mill during the removal process, begin to rotate with the drill or mill. The drill or mill cannot effectively grind away this component which is rotating with the mill or drill, thus hampering the removal. It would be desirable to provide components of the downhole tool with an anti-rotational mechanism to prevent rotation of the components of the downhole tool during removal. It would further be desirable to provide a solid slip ring that engages a structure on the mandrel adapted to prevent rotation of the anchoring assembly with respect to the mandrel.

The present invention is directed to overcoming, or at least reducing the effects of, one or more of the issues set forth above.

SUMMARY OF THE INVENTION

The present application discloses a system adapted to centralize a downhole tool during the tool setting sequence. The system is also adapted to rotationally lock the components of the downhole tool to facilitate subsequent removal, via milling or drilling. In some embodiments, the system is comprised of one slip assembly and one cone, although in other embodiments, a plurality of slip assemblies and cones may be utilized. In some embodiments, the cone has a noncircular inner diameter which is adapted to mate with a non-circular outer diameter of a mandrel. The cone may include at least one longitudinal fin on the outer diameter of the cone.

In some embodiments, the slip ring is comprised of an integral slip assembly having a plurality of longitudinal, axial channels on a faceted, tapered inner surface. The slip assembly is designed to break into a plurality of segments at a predetermined axial force, as described more fully hereinafter. In operation, when an axial force is applied to the slip and cone system described herein, the slip is ramped up on the cone; the integral slip is thus broken into a plurality of slip segments. The fins on the inner tapered surface of the cone, in some embodiments, are adapted to engage and guide the individual slip segments to maintain an even spacing around the perimeter of the mandrel via channels. The slip segments are set against the casing wall. The individual slip segments and the cone are rotationally locked together via the longitudinal fins in the cone mating with the channels in the slip segments.

The present application discloses a cone and an integral slip assembly comprising system for use in the anchoring assembly of a wellbore plug that uses a geometric structure on the cone to break apart the slip ring into designated segments. In one embodiment, a cone has a substantially octagonal shaped inner diameter and includes eight axial fins integral on the exterior of the cone. The eight fins may be spaced equally around the perimeter of the cone. The cone may include an aperture through which a shear pin may be inserted to retain the cone to a mandrel while running the plug into the wellbore to prevent damage to the slip assembly.

The substantially octagonal shaped inner diameter of the cone may mate with the outer diameter of a mandrel, rotationally locking the cone and mandrel together for the easier removal of the wellbore plug by drilling or milling, if necessary. Alternatively, the mandrel may include a key or protrusion and the cone may include a corresponding slot to rotationally lock when assembled together.

The integral slip assembly may be adapted to be broken at least one slot, and into a plurality of slip segments. The slip assembly may include a slot between each adjacent slip segment to encourage the integral slip ring to break into the designated slip segments. Each slip segment may include a channel on the inner tapered surface that mates with a corresponding axial fin on the exterior tapered surface of the cone. The axial fins may be integral with the cone. As the integral slip assembly traverses the cone when set, the channel of each slip segment travels along its corresponding fin. As the integral slip ring traverses the cone, the taper of the cone causes the integral slip assembly to break apart at the slots and separate into the designated slip segments.

In some embodiments, the fins of the cone and channels in each slip segment, in combination with the slots in the integral slip assembly, encourage the integral slip assembly to break into designated slips as the solid slip ring traverses the taper of the cone. The fins may also locate each individual slip segment equally around the perimeter of the cone to ensure that the packing element is centered within the wellbore. Centering of the packing element helps to prevent the premature failure of the packing element due to unbalanced forces on the packing element.

In one embodiment a shear pin may be inserted through an aperture in the cone connecting the cone to a mandrel.

The integral slip assembly may be comprised of a brittle material, such as cast iron. Such a brittle material would aid in the complete separation of the integral slip assembly into the designated slip segments along the grooves once the integral slip assembly has started to traverse the tapered portion of the cone. However, the integral slip assembly could be comprised of various materials, brittle or not, that would function as a slip, such as brass, steel alloys, or a composite material, as would be appreciated by one of ordinary skill in the art having the benefit of this disclosure.

In one embodiment, the integral slip assembly breaks into eight designated slip segments each having a channel. The corresponding cone in this embodiment includes eight integral fins spaced equally around the tapered surface of the exterior of the cone. As one of ordinary skill in the art having the benefit of this disclosure would appreciate, the number and configuration of the slip segments, the slots in the integral slip assembly, and the fins on the cone could be varied as desired, to provide that the integral slip assembly breaks into designated slip segments spaced around the cone on integral fins. Further, the configuration and shape of the geometry, namely the fins, used to encourage the integral slip assembly to break into designated segments could be varied would be recognized by one of ordinary skill in the art having the benefit of this disclosure. For example, the cone could have two fins per segment, or each segment could include a protrusion that travels along a corresponding track in the exterior of the cone.

Figure 1:
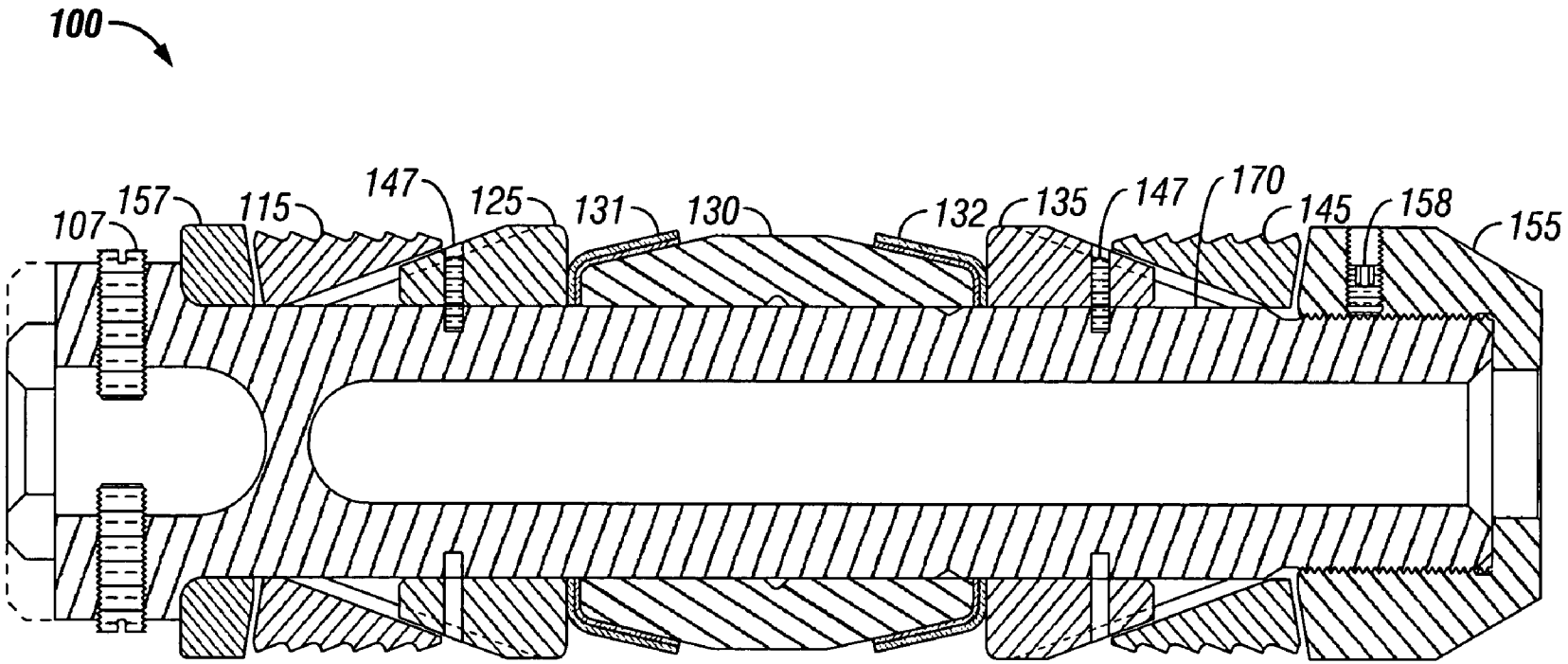
FIG. 1 shows an exemplary downhole tool having slips and cones.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the use of designs for non-rotational cone and integral slip ring for use with a downhole tool. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 depicts a downhole tool, such as bridge plug assembly 100. Generally, as would be realized by one of ordinary skill in the art, the downhole tool is comprised of center mandrel 170. On the lower end of the bridge plug assembly 100 is a lower end cap 155 attached to the mandrel 170 and secured via a set screw 158.

The mandrel 170 is the general support for each of the components of the downhole tool, such as bridge plug assembly 100. Above the lower end cap 155 is a lower slip ring 145 arranged about the mandrel 170. The lower slip ring 145 has an inner tapered surface the mates with a tapered outer surface of lower cone 135.

A packing element 130 is shown above the lower cone 135. The packing element 130 is a generally elastomeric component. The packing element 130 may include an inner backup 132 and an outer backup 131, which help to prevent undesired extrusion of the packing element 130. An upper cone 125 abuts the upper end of the packing element 130. An upper slip ring 115 may be arranged about the mandrel 170 and be located adjacent to the upper cone 125. A shear pin 147 may fasten the upper cone 125 and the lower cone 135 to the mandrel 170.

In the embodiment shown, the mandrel prevents fluid flow through the downhole tool. However, in another embodiment the mandrel may be hollow and the tool may include a plug to prevent fluid flow through the downhole tool. By exchanging the plug with a valve, the downhole tool can be converted to a frac plug or cement retainer, as desired, as would be realized by one of ordinary skill in the art.

To set the tool of FIG. 1, a downward force is applied to an upper ring 157 via a setting tool (not shown) while the mandrel 170 is pulled upwardly. The setting tool may be connected to the mandrel 170 via shear screw 107. The downward force by the setting tool compresses the components between the upper ring 157 and the lower end cap 155.

As discussed above, one or more shearing devices, such as a shear pin 147, may extend between the upper cone 135 and the mandrel 170. The shear pin 147 precludes the premature setting of the anchoring assembly in the wellbore during run-in. The relative movement between the upper cone 125 and the upper slip ring 115 causes the upper slip ring 115 to move in a radially-outward direction and into engagement with the casing wall. At some point of travel along the upper cone 125, the upper slip ring 115 will break into segments allowing the upper slip ring 115 to engage the casing wall.

Continued downward force applied to the tool causes the upper shear pin 147 to shear off the inner backup 132 and outer backup 131 to flare out away from the mandrel 170 allowing the packing element 130 to expand to the well casing to create a fluid seal isolating a portion of the well bore. Continued downward force shears off the lower shear pin 147 allows the lower slip ring 145 to ride up the lower cone 135 to set against the casing, similar to the action of the upper cone 125 and upper slip ring 115. After setting the downhole tool, a force may be applied to shear the shear screw 107 releasing the setting tool from the bridge plug assembly 100.

As discussed above, prior slip rings or integral slip assemblies may be prone to breaking at only one location in some application, forming a c-ring. The break in the c-ring does not center the slips, cone, or packing element; rather these elements of the anchoring assembly shift towards the break. The shift of these components causes the packing element to be offset from the center of the wellbore possibly leading to the premature failure of the packing elements.

Once properly set, the downhole tool may function as intended. When the downhole tool has served its purpose, the tool 100 may be removed. To remove the downhole tool, the downhole tool may be drilled or milled from the wellbore. The mandrel 170 may have a non-circular cross-section, as described in U.S. Pat. No. 6,491,108, by Gabriel Slup and Douglas J. Lehr, assigned to BJ Services Company of Houston, Tex., incorporated by reference in its entirely herein.

Likewise, the solid slip rings may have corresponding cross-section to rotationally lock the mandrel 170 with the cones 135, 125. The non-circular cross-section of the mandrel 170 provides a rotational lock between the mandrel and the other components of the bridge plug. The non-rotation of the mandrel 170 allows for the easier removal of the downhole tool 100 by drilling or milling.

Figure 2:
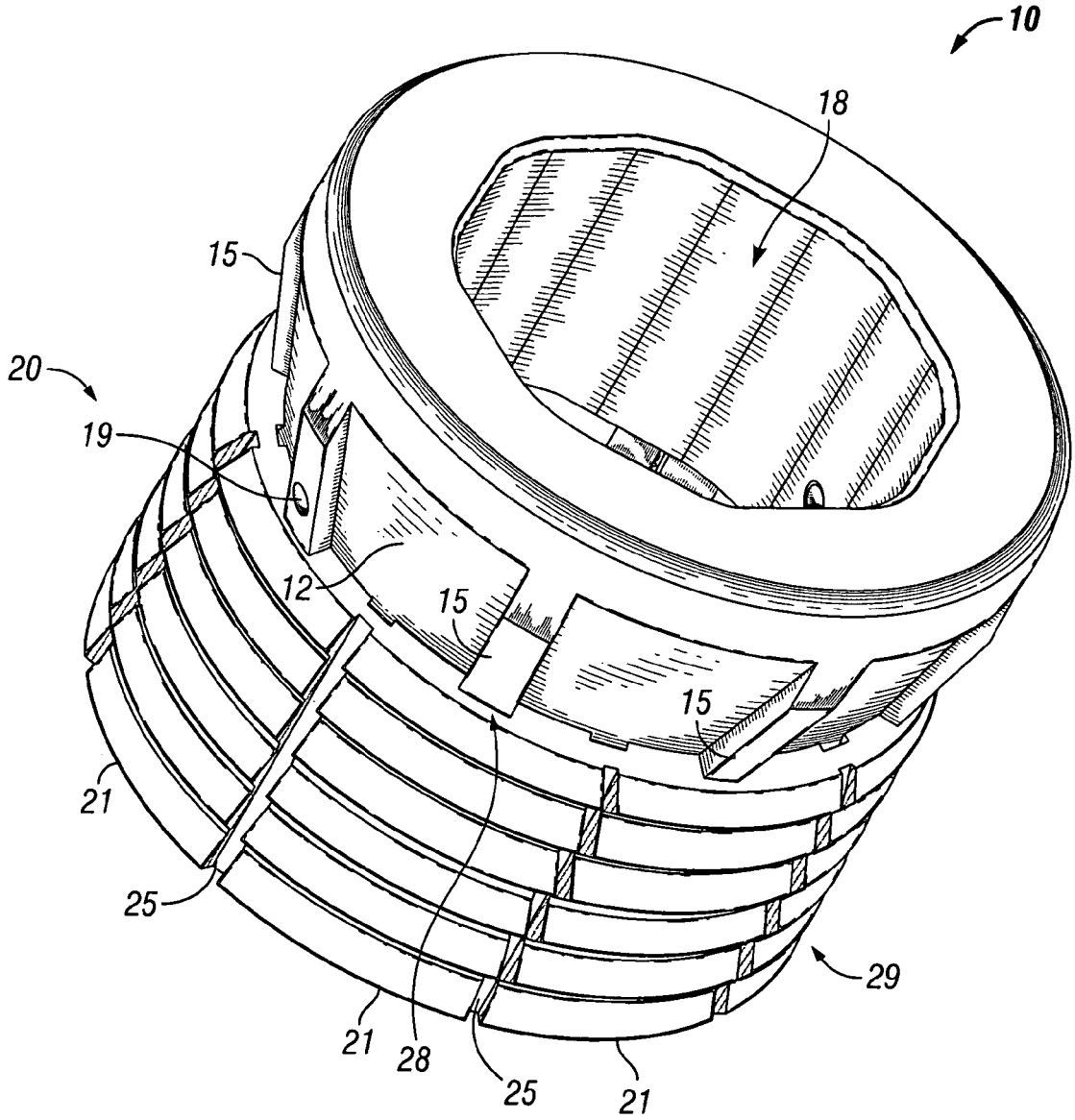
FIG. 2 shows an embodiment of the present disclosure of the improved cone and integral slip ring system for a downhole tool, with the slip and cone being in an initial configuration (i.e. such as when the downhole tool is being run in hole).

FIG. 2 shows one embodiment of the present disclosure of an improved cone 10 and integral slip assembly 20 for a downhole tool. For the purposes of clarity, FIG. 2 focuses only on the cone 10 and integral slip assembly 20. However, as would be realized by one of ordinary skill in the art having the benefit of this disclosure, the cone 10 and integral slip assembly 20 of FIG. 2 may be used in place of the cones 125, 135 and slip rings 145, 115, respectively, of the downhole tool of FIG. 1. In other words, the cone 10 and slip assembly 20 of FIG. 2, may be set downhole and utilized in conjunction with the other components of the downhole tool 100 described in FIG. 1.

Referring again to FIG. 2, the cone 10 has an inner diameter 18 adapted to mate with the mandrel (not shown). The outer perimeter of the cone 10 includes a tapered surface 12. The cone 10 may include at least one fin 15. In the embodiment shown, eight integral fins 15 are shown running axially along the tapered surface 12 of the cone 10. The fins 15 may be cast or constructed by machining the area between of the fins 15. Alternatively, the fins 15 could be attached to the cone 10 via mechanical means, for example.

The fins 15 may be positioned equidistantly around the perimeter of the tapered surface 12 of the cone 10. The cone 10 may include apertures 19 through which a retaining device, such as a shear pin, may be inserted to retain the cone 10 against the mandrel (not shown, but described above). The cone 10 may be initially retained against the mandrel to prevent damages to the integral slip assembly 20 (described hereinafter) due to the movement of the cone 10 while running the downhole tool into the wellbore.

The inner diameter 18 of the cone 10 may be non-circular, such as the substantially octagonal inner diameter shown in FIG. 2. The non-circular inner diameter 18 of the cone 10 may rotationally lock the cone 10 and mandrel (not shown) when assembled.

Also shown in FIG. 2 is the integral slip assembly 20. The slip assembly 20 shown includes an inner tapered surface 22 adapted to mate with the tapered surface 12 of the cone 10. The integral slip assembly 20 may include at least one slot 25 extending axially along the perimeter of the integral slip assembly 20. The integral slip assembly 20 shown includes eight slots 25. The slots 25 along the integral slip assembly 20 may be used to define a plurality of slip segments 21 therebetween. In an initial, run-in position, the slots 25 do not extend completely through the thickness of the integral slip assembly 20; thus the integral slip assembly is truly integral: comprising one piece. However, as explained hereinafter, when set, the integral slip assembly 20 breaks along slots 25 into individual slip segments 21.

The integral slip assembly 20 also includes at least one channel 28 on the inner tapered surface 22. In the embodiment shown in FIG. 2, one channel 28 is associated with each slip segment 21. The channel 28 runs axially along the integral slip assembly 20. As will be described hereinafter, each channel 28 is adapted to mate with a corresponding fin 15 of the cone 10.

Each of the slip segments 21 may also include a plurality of teeth 29 across its outer perimeter, as shown in FIG. 2. These teeth 29 may be formed in the slip segments via machining, or may comprise hardened inserts. The teeth 29 may be provided to facilitate the gripping of the wellbore when the downhole tool is set.

Operation of the integral slip assembly 20 and cone 10 will now be described in conjunction with FIGS. 2, 3, and 4. Referring to FIG. 2, the integral slip assembly 20 is in its initial position. Each component is circumscribed on a mandrel (now shown, but described above). Channels 28 on the inner tapered surface 22 of the integral slip assembly 20 are circumferentially aligned with the fins 15 on the tapered surface 12 of the cone 10.

As an axial force is applied to the downhole tool, the tapered surface 22 of the integral slip assembly 20 traverse the tapered surface 12 of the cone 12. Thus, as the axial force is applied to the downhole tool, the integral slip assembly 20 traverses the cone 10; further, the channel 28 travels along a corresponding fin 15 on the exterior of the cone 10. As the integral slip assembly 20 traverses the tapered surface 12 of the cone 10, the integral slip assembly 20 breaks apart as shown in FIG. 3. The slots 25 weaken the strength of the integral slip assembly 20; thus, the integral slip assembly 20 breaks at the slots 25, into individual slip segments 21. The channels 28 mating with the fins 15 operate to facilitate the integral slip assembly 20 breaking at each slot 25.

Figure 3:
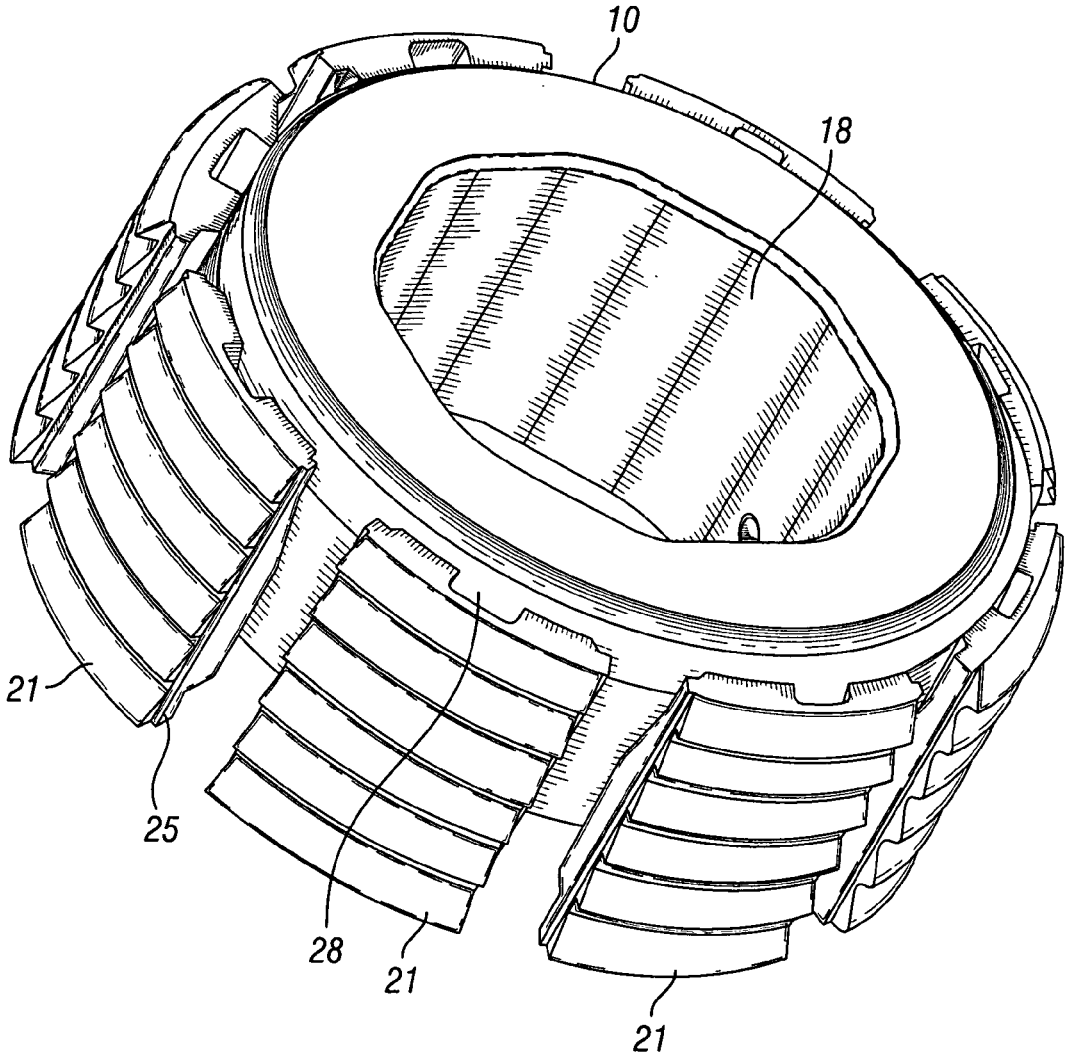
FIG. 3 is a top perspective view of the embodiment of FIG. 2, wherein the slip assembly has traversed the cone, to break the slip assembly into predetermined equally spaced slip segments.

FIG. 3 is a top view of the embodiment of FIG. 2 after the integral slip assembly 20 has traversed the cone 10, breaking the integral slip assembly 20 into slip segments 21. The fins 15 of the cone 10 and channels 28 in each slip segment 21 in combination with the slots 25 provide that the integral slip assembly 20 breaks into designated slip segments 21. The fins 15 also ensure that each slip segment 21 is advantageously located around the cone 10. The location of the slip segments 21 may provide that the anchoring assembly of a plug, and in particular the packing element, is centered within the wellbore. Centering of the packing element helps to prevent the premature failure of the packing element due to unbalanced forces on the packing element.

Further, as described above, the use of the channels 28 mating with the fins 15, in combination with the slots 25, reduces the likelihood that the integral slip assembly 20 breaks along only one slot 25. Recall, that if a solid slip ring breaks at only one location, the slips become arranged as a c-ring, thus not properly setting the downhole tool.

Finally, the channels 28 aligning with the fins 15 provides yet another advantage. When the tool is subsequently removed, a drill or mill is run downhole. In some prior art systems, either the cone or the slips will begin to turn with drill bit or mill. Thus, the cone and the slips rotate relative to each other, thus hampering the removal process. Therefore, it is desirable that the slips and the cones do not rotate relative to each other to hasten removal by the mill or drill. The channels 28 mating with the fins 15 provide an anti-rotation mechanism to facilitate removal of the tool.

Figure 4:
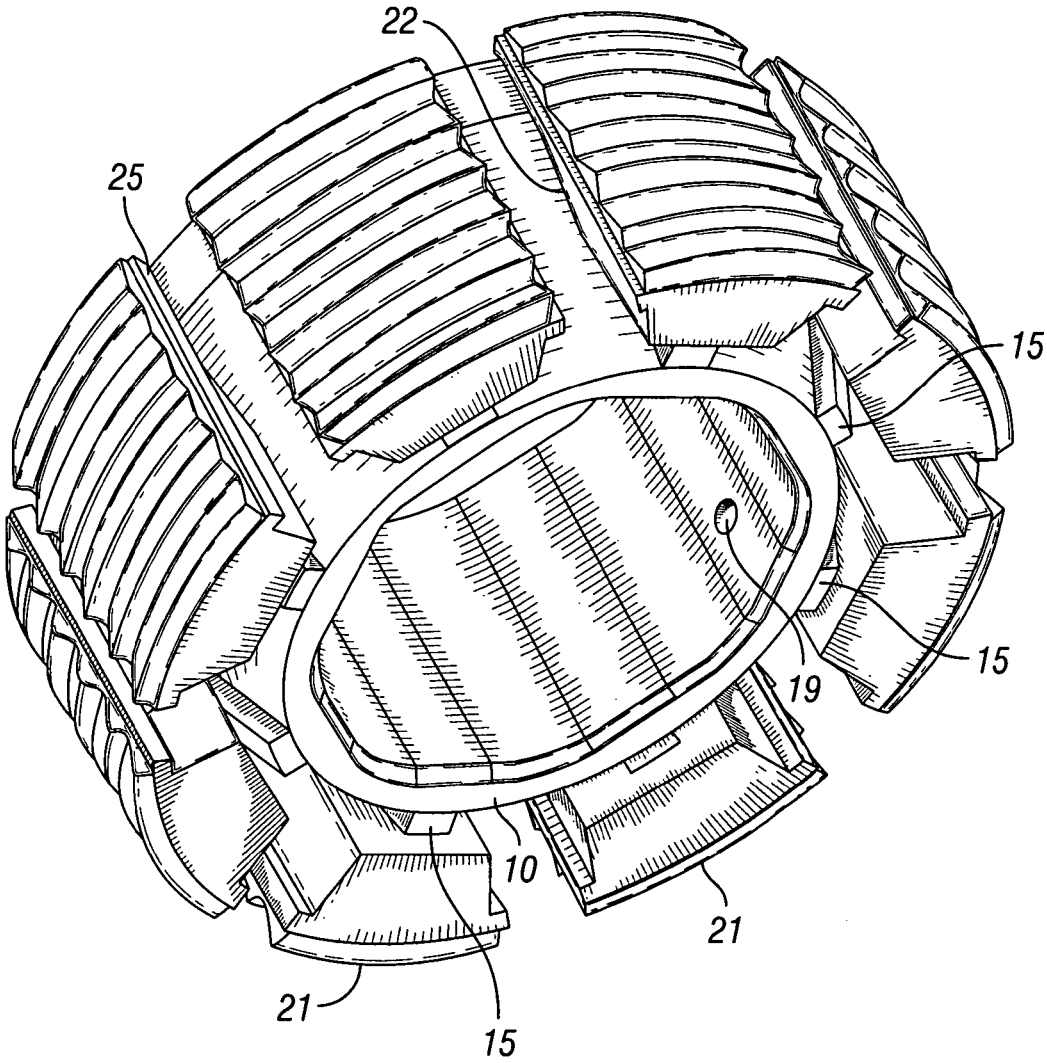
FIG. 4 is a bottom perspective view of the embodiment of FIG. 2 wherein the slip assembly has traversed the cone to break the slip assembly into predetermined equally spaced slip segments.

In the embodiments shown in FIGS. 2-4, the inner diameter 18 of the cone 10 is also provided with a non-circular cross section. When mated with a mandrel having a non-circular cross-section, rotation between the cone and mandrel is not possible. Thus, again, removal of the tool is facilitated via the use of this anti-rotational locking mechanism. Thus, the shape of the mandrel as well as the inner diameter of the cone may be adapted to prevent the rotation of the mandrel. Rotationally locking the mandrel provides for the easier removal of the mandrel by drilling, milling, or similar means. Alternatively, the cone may contain a key slot that mates with a protrusion on the mandrel rotationally locking the mandrel and cone, as discussed hereinafter.

As discussed above, a shear pin may be inserted through aperture 19 temporarily connecting the cone 10 and the mandrel together to prevent damage to the integral slip assembly 20 while running the plug into the wellbore. The shear pin may be used to require the minimum amount of force necessary to cause the integral slip assembly 20 to traverse the cone 10. For example, the location of the shear pin may prevent the movement of the integral slip assembly 20 along the cone 10 until the force applied is great enough for the integral slip assembly 20 to shear the shear pin.

The operation of one integral slip assembly 20 engaging with improved cone 10 has been described. However, as would be known to one of ordinary skill in the art having the benefit of this disclosure and the operation of the tool of FIG. 1, more than one integral slip assembly 20 could be provided on a downhole tool, each integral slip assembly adapted to mate with a cone 10. For example, the downhole tool, such as the bridge plug of FIG. 1, could be provided with an upper integral slip assembly 20 mating with an improved upper cone 10, as well as a lower integral slip assembly 20 mating with a lower improved cone 10.

Also, it is noted that the fins 15 mating with channels 28 do not have to be perfectly axially aligned. For instance, the fins 15 may be provided in an axially angled or helical configuration provided the channels 28 are similarly shaped to mate with fins 15. Furthermore, the fins can be part of slip and the channels can be on the cones, as would be realized by one of ordinary skill in the art having the benefit of this disclosure.

The integral slip assembly 20 may be comprised of a brittle material such as cast iron. Such a material aids in the complete separation of the integral slip assembly 20 along the grooves 25 into slip segments 21 once the integral slip assembly 20 has begun to traverse the cone 10. The integral slip assembly 20 may also be comprised of any type of materials, metallic or non-metallic such composite material, as would be appreciated by one of ordinary skill in the art having the benefit of this disclosure. Similarly, the cone may be comprised of metallic or nonmetallic (e.g. composite) materials.

FIG. 4 is a bottom perspective view of the embodiment of FIG. 2 after the integral slip assembly 20 has traversed the cone 10 breaking the integral slip assembly 20 into slip segments 21. FIG. 4 shows an integral slip assembly 20 that has broken into eight designated slip segments 21 each having a channel 28. The cone 10 in this embodiment includes eight fins 15 spaced equally around the exterior of the cone 10. As one of ordinary skill in the art having the benefit of this disclosure would appreciate, the number and configuration of the slip segments 21, the channels 28, and the slots 25 in the integral slip assembly 20, and the fins 15 on the cone 10 could be varied to provide that the integral slip assembly 20 breaks into designated slip segments 21 spaced around the cone 10 on integral fins 15.

Figure 5:
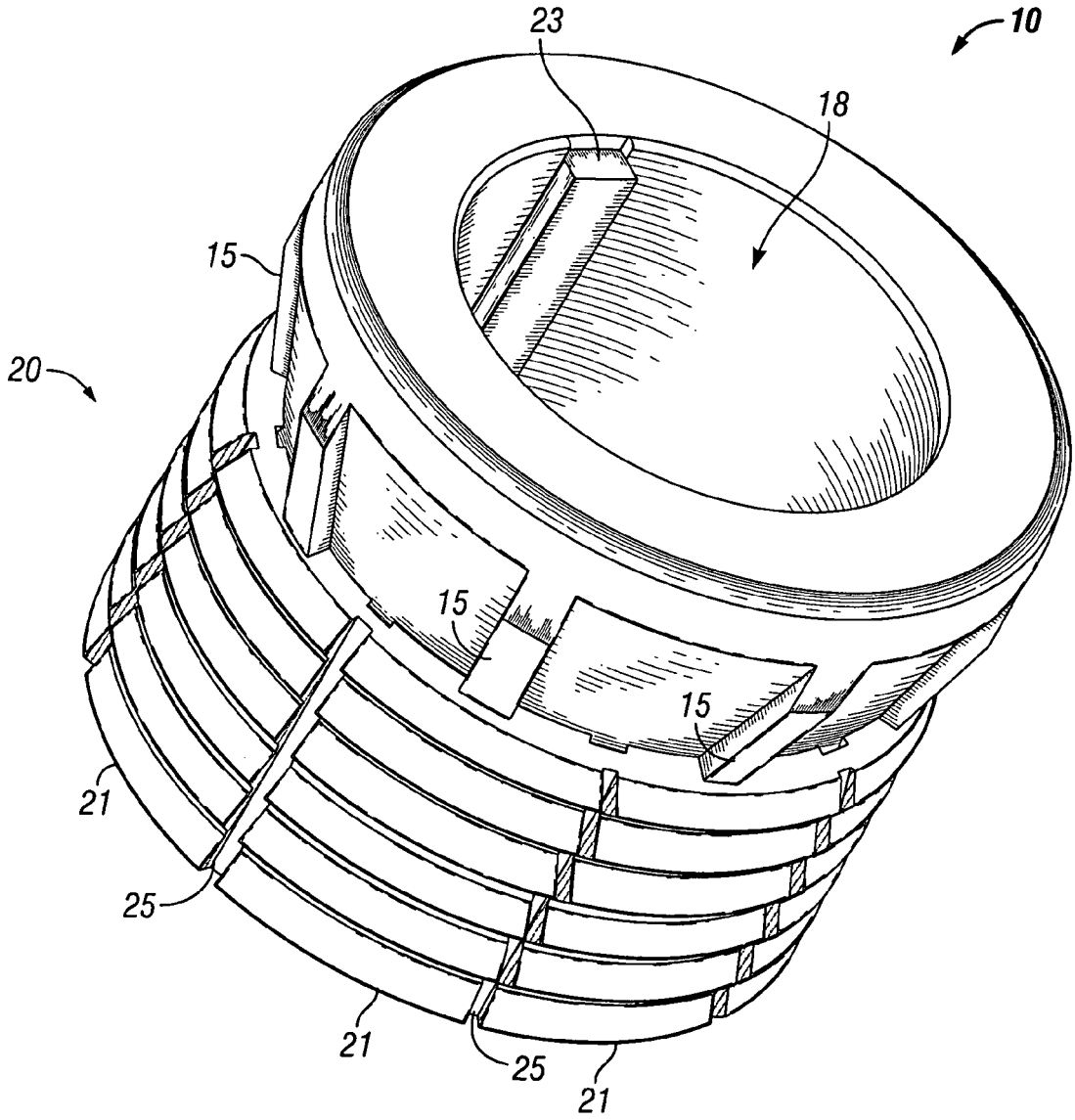
FIG. 5 is a perspective view of an embodiment of the present disclosure of the improved cone and integral slip assembly wherein the cone has a circular inner diameter and a rotational locking key.

In the embodiment shown in FIG. 5, the inner diameter 18 of the cone 10 may be generally circular in cross-section and include a non-rotational key 23. The non-rotational key 23 mates into a corresponding slot in a mandrel (not pictured) rotationally locking the mandrel and the cone 10 together. Although the non-rotational key 23 of this embodiment has a square cross-section, it would be appreciated by one of ordinary skill in the art that the non-rotational key 23 could be designed of various shapes that may mate with a corresponding structure on the mandrel to rotationally lock the mandrel and the cone 10 together.

Figure 7:
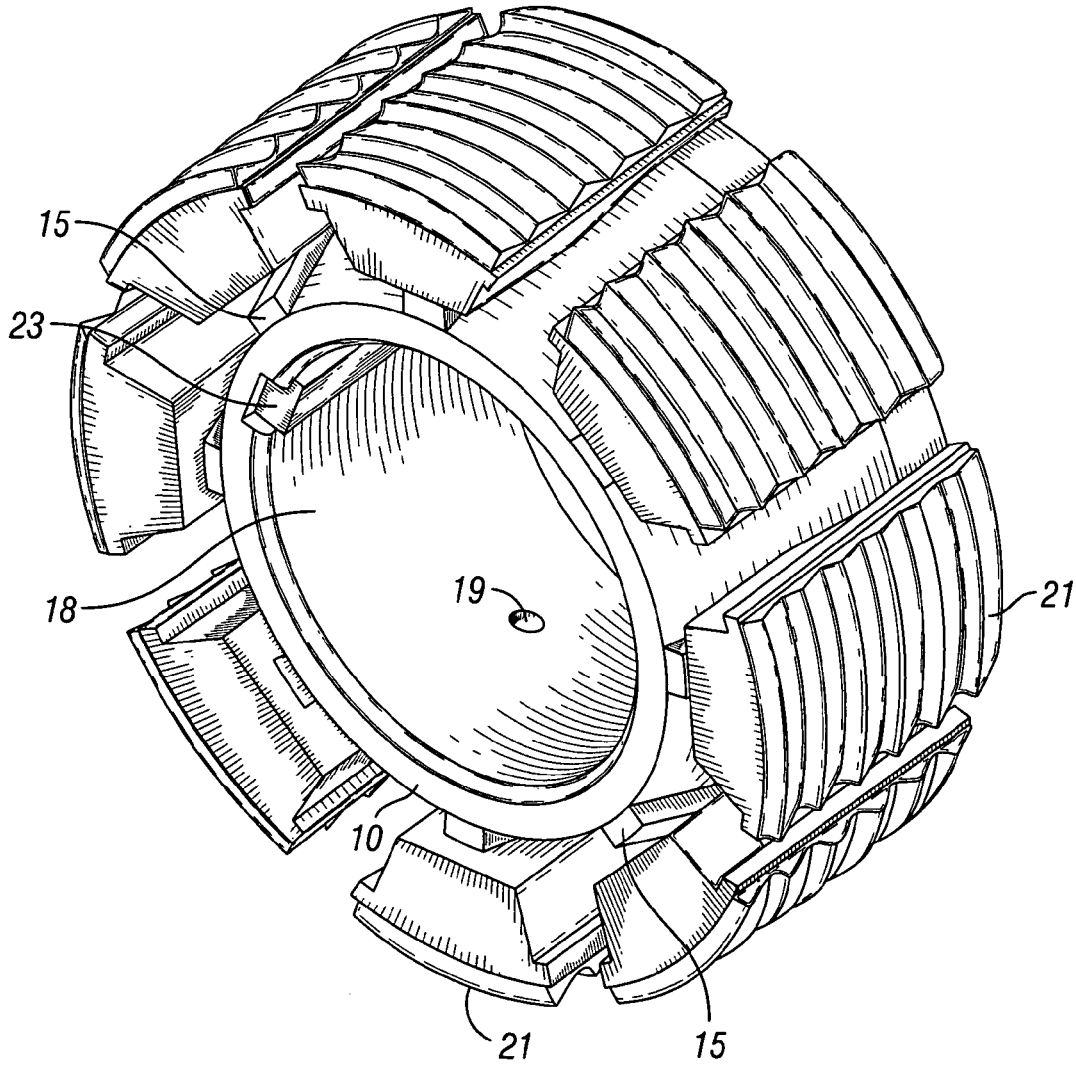
FIG. 7 is an exploded perspective view of the embodiment of FIG. 5 that further illustrates the fins on the outer exterior of the cone.

The cone 10 of FIG. 5 includes external integral fins 15 as better shown in FIG. 7 that are in the axial direction. The fins 15 are positioned equilaterally around the cone 10. The positioning of the fins 15 ensures the proper spacing of the slip segments 21 to position the anchoring assembly of the plug in the center of the wellbore.

Figure 6:
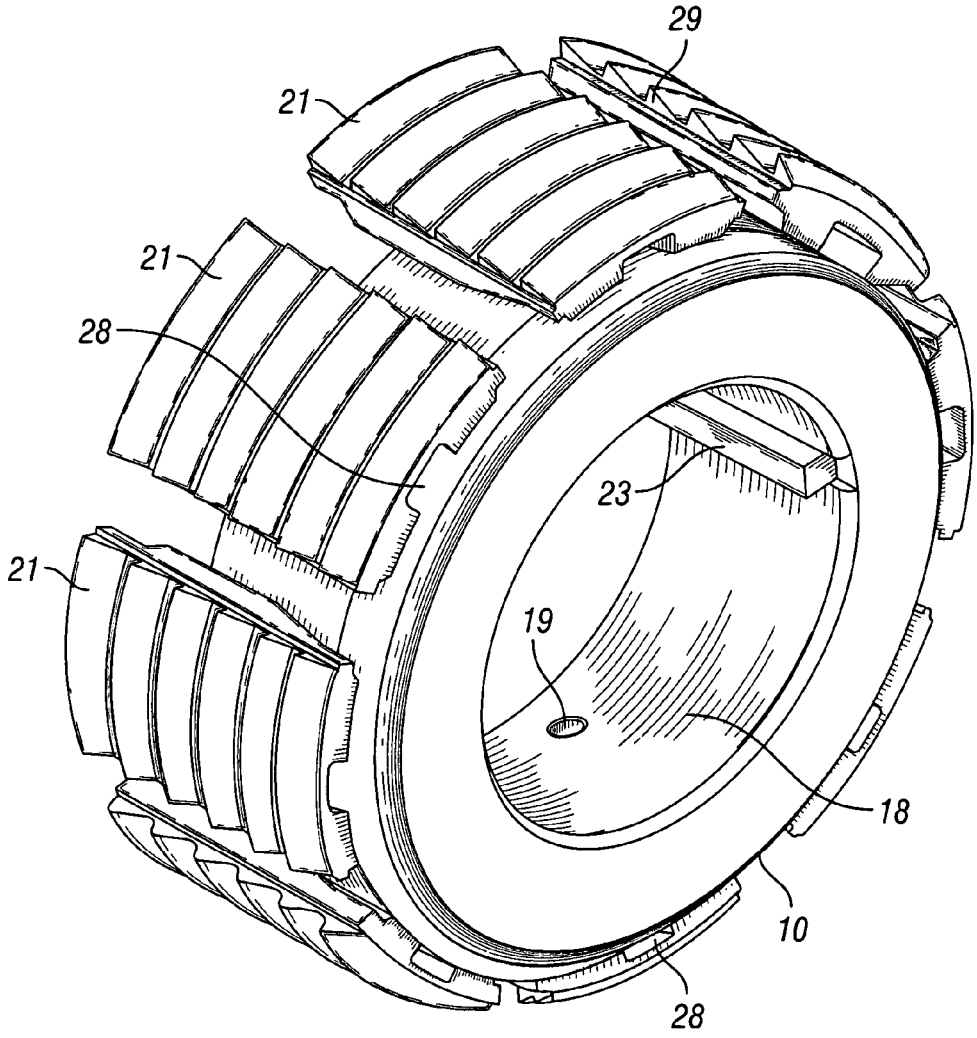
FIG. 6 is an exploded perspective view of the embodiment of FIG. 5 that further illustrates channels in each slip segment and the groove in the cone.

The integral slip assembly 20 of FIG. 5 is composed of slip segments 21 defined by slots 25. Each slip segment 21 includes a channel 28 as shown in FIG. 6. The channel 28 of each slip segment 21 is adapted to mate with a corresponding fin 15 of the cone 10. As force is applied to the anchoring assembly, the integral slip assembly 20 moves up the cone 10, the channels 28 traveling along the corresponding fins 15. As the slip assembly 20 traverses the taper of the cone 10, the taper causes the integral slip assembly 20 to break apart as shown in FIGS. 6 and 7. The fins 15 ensure that the slip segments 21 are properly distributed around the perimeter of the cone 10 and encourage the integral slip assembly 20 to break apart in the slip segments 21 at the designated slots 25.

The slots 25 may assist in the clean separation of the slip assembly 20 into individual slip segments 21.

Although various embodiments have been shown and described, the invention is not so limited and will be understood to include all such modifications and variations as would be apparent to one skilled in the art.

What is claimed is:

1. A system for anchoring a downhole tool having a mandrel in a wellbore comprising:

a cone disposed on the mandrel, the cone having a tapered outer surface with at least two substantially axial fins; and an integral slip assembly having a tapered inner surface with at least two channels, and at least two slots, the channels on the inner surface of the integral slip assembly mating with the axial fins on the cone, to break the integral slip assembly along the slots into a plurality of slip segments as an axial force is applied to move the slip assembly relative to the cone.

2. The system of claim 1 wherein the axial fins center the plurality of slip segments around the cone.

3. The system of claim 1 wherein the axial fins rotationally lock the plurality of slip segments with respect to the cone.

4. The system of claim 1 wherein the cone has a noncircular inner diameter adapted to mate with the outer diameter of the mandrel to rotationally lock the cone with respect to the mandrel.

5. The system of claim 1 further comprising a shear pin that selectively retains the cone on the mandrel, wherein the shear pin is positioned within an aperture of the cone.

6. The system of claim 1 wherein the cone has a substantially octagonal shaped inner diameter.

7. The system of claim 6 wherein the cone includes eight substantially axial fins equally spaced around the perimeter of the cone.

8. The system of claim 6 wherein the substantially octagonal shaped inner diameter of the cone rotationally locks with the outer diameter of the mandrel.

9. The system of claim 8 wherein the outer diameter of the mandrel is substantially octagonal shaped.

10. The system of claim 1 wherein the mandrel includes a protrusion that engages a slot in the cone to rotationally lock the cone on the mandrel.

11. The system of claim 1 wherein the cone includes a protrusion that engages a slot in the mandrel to rotationally lock the cone on the mandrel.

12. The system of claim 1 wherein the integral slip assembly is comprised of a metallic material.

13. The system of claim 1 wherein the integral slip assembly is comprised of a non-metallic material.

14. The system of claim 1 wherein the integral slip assembly is comprised of a brittle material.

15. The system of claim 14 wherein the brittle material is cast iron.

16. The system of claim 1 wherein the outer perimeter of the plurality of slip segments include teeth.

17. The system of claim 1, wherein the fins and the slots are staggered in relation to one another along the integral slip assembly.

18. A system for anchoring a downhole tool having a mandrel in a wellbore comprising:

a cone disposed on the outer diameter of the mandrel, the cone having a tapered outer surface;

an integral slip assembly having a tapered inner surface adapted to move along the outer diameter of the cone;

means for breaking the integral slip assembly into a plurality of designated slip segments as the integral slip assembly moves with respect to the cone; and means for positioning the plurality of designated slip segments equally around the outer perimeter of the cone, wherein the means for breaking the integral slip assembly and the means for positioning the plurality of designated slip segments are staggered in relation to one another.

19. The system of 18 wherein the means for breaking the integral slip assembly into a plurality of designated slip segments comprises at least two slots in the integral slip assembly.

20. The system of 18 wherein the means for positioning the plurality of designated slip segments equally around the perimeter of the cone comprises at least two substantially axial fins on the outer surface of the cone and at least two channels on the inner surface of the integral slip.

21. The system of 18 wherein the means for positioning the plurality of designated slip segments equally around the perimeter of the cone comprises at least two protrusions on the inner surface of the integral slip and at least two channels in the exterior of the cone.

22. The system of claim 18 further comprising means for releasably securing the cone to the outer diameter of the mandrel.

23. The system of claim 18 wherein in the means for positioning the plurality of designated slip segments equally around the outer diameter of the cone also provides means for rotationally locking the plurality of designation slip segments with respect to the cone.

24. The system of claim 18 further comprising means to rotationally lock the cone with respect to the mandrel.

25. A method of setting a downhole tool having a mandrel comprising:

running the downhole tool into a wellbore to a desired location, the downhole tool including at least one cone and at least one integral slip assembly disposed on the outer diameter of the mandrel, wherein the cone has a tapered outer surface and the integral slip assembly has a tapered inner surface;

applying a force on the downhole tool, wherein the force causes relative movement of the integral slip along the outer perimeter of the cone, the integral slip being guided by a plurality of fins; and breaking the integral slip assembly into designated slip segments equally spaced around the outer perimeter of the cone using a plurality of slots, wherein the fins and slots are staggered in relation to one another.

26. The method of claim 25 further comprising securing the cone disposed on the outer diameter of the mandrel with a shearable device.

27. The method of claim 26 further comprising shearing the shearable device releasing the cone from the mandrel.

28. The method of claim 25 further comprising locking rotationally the designated slip segments lock with respect to the cone.

29. The method of claim 28 further comprising locking rotationally the cone with respect to mandrel.

30. The method of claim 29 further comprising removing the downhole tool from the well bore by drilling or milling.

* * * * *